United States Patent [19]

Galbraith

[11] Patent Number: 4,766,709

[45] Date of Patent: Aug. 30, 1988

[54] DOUBLE-PANED WINDOW SECUREMENT

[75] Inventor: Darrell L. Galbraith, Overland Park, Kans.

[73] Assignee: Midland Glass Company, Merriam, Kans.

[21] Appl. No.: 43,024

[22] Filed: Apr. 27, 1987

Related U.S. Application Data

[63] Continuation-in-part of Ser. No. 856,816, Apr. 28, 1986, abandoned.

[51] Int. Cl.[4] ..... E06B 3/24

[52] U.S. Cl. ..... 52/235; 52/403; 52/788; 52/304; 52/208

[58] Field of Search ..... 52/304, 171, 172, 403, 52/397, 398, 400, 790, 235, 788, 483, 208

[56] References Cited

U.S. PATENT DOCUMENTS

| | | | |
|---|---|---|---|
| 2,430,873 | 11/1947 | Haas | 52/208 |
| 2,748,431 | 6/1956 | Eriksson | 52/403 |
| 3,343,317 | 9/1967 | Cripe | 52/403 |
| 4,134,238 | 1/1979 | Auger | 52/397 |
| 4,500,572 | 2/1985 | Francis | 52/172 |
| 4,552,790 | 11/1985 | Francis | 52/304 |
| 4,669,241 | 6/1987 | Kelly | 52/400 |

FOREIGN PATENT DOCUMENTS

| | | | |
|---|---|---|---|
| 1086875 | 8/1960 | Fed. Rep. of Germany | 52/403 |
| 1203877 | 8/1959 | France | 52/790 |
| 2167110 | 5/1986 | United Kingdom . | |

*Primary Examiner*—James L. Ridgill, Jr.

*Attorney, Agent, or Firm*—Willian Brinks Olds Hofer Gilson & Lione Ltd.

[57] ABSTRACT

A sturdy and reliable mount for a double-paned glass unit that is readily used with standard glass units and frames, that is easily installed, that eliminates the need for endcaps or exterior stops, and that uses a flexible connector member as part of the mount is disclosed. The application of such a securement as a secondary mount to back-up a primary mount for a double-paned glass unit, such as a structural silicone adherent, is a particularly advantageous use of the invention. An embodiment includes a resilient, or flexible, elastomeric member having a first portion received in a channel formed between the glass plates of a double-paned glass unit and a second portion extending beyond the perimeter of the glass unit. The second portion of the resilient member is fixed to the structure on which the glass unit is to be mounted, such as a building. The invention can also be used with a double-paned glass unit having an inset exterior glass plate. The means for fixing the resilient member to the building may advantageously take the form of a separate anchor member that can be fixed to the building, and which interlocks with the second portion of the resilient member. A sliding interfit between complimentarily contoured portions of the resilient member and the anchor member in a tongue and groove-type of engagement is shown. Several embodiments of the anchor member are disclosed, as well as an embodiment of an integrally molded dual-durometer resilient mount.

17 Claims, 5 Drawing Sheets

DOUBLE-PANED WINDOW SECUREMENT

This application is a continuation-in-part of U.S. Ser. No. 06/856,816 filed on Apr. 28, 1986 now abandoned.

FIELD OF THE INVENTION

This invention generally relates to mounting double-paned window units to buildings, and more particularly to a system providing a secondary or safety mount for securing a sealed double-paned window unit to a building.

BACKGROUND OF THE INVENTION

Glass units made from two, and sometimes more, panes of glass are well known. They are particularly used as insulating glass units where the two panes, or lights, of glass are sealed together in spaced apart relation. Spacers separate the two lights, and are affixed to the respective lights around the entire perimeter of the combined lights. The lights are thus sturdily secured into a unit with an air or other gas layer typically trapped between the two lights, establishing the insulative character of the unit.

Fairly large glass units may be used on office buildings and the like, such as glass units running from floor to ceiling. A number of different techniques have been developed to attach such glass units to a building. One method, for instance, is to attach the glass unit using end caps or exterior stops. The end caps or stops overlie the outside light of the unit and are anchored or clamped to the building. Such a mounting mechanism is shown in U.S. Pat. No. 3,367,077 for example, although a double-paned unit is not described therein.

While the foregoing method provides a very good attachment of the glass unit to the building, many buildings call for mounting the units without the use of exterior stops or caps. One common way to accomplish this is to adhere the interior light of the unit directly to the building. This can either be done in the field, or by adhering the unit to a frame remote from the job and then attaching the frame in place on the building (commonly referred to as unitization). In either case, the structural adherent used would ordinarily be a one or two part silicone sealant, preferably one that cures rapidly. The sealant is applied around the entire periphery of each unit to further weather-seal the unit to the building.

It will of course be readily appreciated that the entire weight of the unit is borne by the sealant. Wind forces are also directly borne by the sealant, as are stretching forces imposed by the expansion and contraction of the interior light. If the sealant fails, which unfortunately does occur, the entire unit will fall out of the building. Such potentially catastrophic failure of the sealant is typically hard to detect, unless the elements are observed leaking around the glass unit. Moreover, the seeds for sealant failure can be initially sown if the building is not properly surfaced for good adhesion, which can be difficult to accomplish and inspect in the field. Four sided silicone systems, while attractive to the industry, have nevertheless found disfavor for these reasons.

SUMMARY OF THE INVENTION

It is a principal objective of this invention to provide a sturdy and reliable mount for a double-paned glass unit that is readily used with standard glass units and frames, that is easily installed, that eliminates the need for endcaps or exterior stops, and that uses a flexible connector member as part of the mount. The application of such a mount as a secondary mount to back up a primary mount for a double-paned glass unit, such as a structural silicone adherent, is a more particular aspect of this principal objective.

Yet another objective of the present invention is to provide the foregoing mount for use with a double-paned glass unit having an inset exterior light.

Still another objective of the present invention is to provide an integral flexible mount of the foregoing type formed of an elastomeric material having a first portion of a lower durometer which engages the interior light, and a second portion of a higher durometer which is attached to a structure to which the glass unit is secured.

These objectives are met by the present invention which comprises a resilient or flexible member having a first portion which engages substantially only the edge of a face of the interior light of a double-paned glass unit, and a second portion extending beyond the perimeter of the glass unit. The second portion of the resilient member is fixed to the structure on which the glass unit is to be mounted, such as a building. The first portion can be received in a channel formed between the glass plates, and engages the edge of the face of the interior light (within the channel). Since only the edge of this face of the interior light is engaged, however, the mount of this invention is equally useful with a glass unit having an exterior light which is inset relative to the interior light.

The means for fixing the resilient member to the building may take the form of a separate anchor member that can be fixed to the building, and which interlocks with the second portion of the resilient member. The interlock advantageously uses a sliding interfit between complimentarily contoured portions of the resilient member and the anchor member in a tongue and groove-type of engagement.

Another embodiment provides for the first portion to be of a lower durometer elastomeric material than an integral second portion. The second portion has a substantial stiffness, with a serrated end that is insertable in an appropriately configured socket for ready fixation of the resilient member.

In one present embodiment, the resilient member is an elongated block of a rubber or elastometric material, such as EPDM. The block has a first portion that is sized to fit between the panes or lights of the double-paned glass unit in a recessed channel typically formed about the unit's perimeter. A second portion of the block extends beyond the perimeter of the glass unit. The second portion is formed with a contoured surface presenting one, and preferably more, laterally extending (i.e. perpendicular to the general plane of the glass unit) flanges or ridges. These ridges run along the longitudinal length of the block.

The anchor member used with the aforementioned embodiment is an L-shaped metal bracket. The base of the L is fixed to the building, as by welding it to a mullion. The other part of the L has a surface contour formed therein that is complimentary to that of the block's second portion, so that the block and anchor interfit and interlock. For example, the surface of the L of this embodiment has a recessed channel defined therein within which one of the block flanges is received in a tongue and groove interengagement.

The foregoing mount has found particular application in a system for mounting such double-paned glass units to a building. The utility of the invention is not necessarily limited to double-paned glass units, however, and the invention could be used with similar double-paned materials requiring secure mounting to a structure without exterior stops or endcaps.

While the invention could readily be applied as a primary mount for such a glass unit, it is presently considered to be most useful as a secondary or safety mount to a primary mounting using a silicone adherent. That is, the glass unit is adhesively secured to the building in a conventional fashion, and the mount of the present invention is employed as a back-up in the event of the failure of the adherent. So applied, the glass unit could be field-glazed or attached to the building in a unitized arrangement using standard techniques.

In use of the mount, the anchor L's are preferably positioned about the perimeter of the unit and fixed in place, as by welding to the mullion. The mounting blocks are then interlocked with respective L's by inserting the first portion of a block into the channel between the glass lights and longitudinally sliding the second portion into the complimentary recess of the L.

The anchor L's can furthermore have a barbed or ratcheted base leg or flange, which is press fit into an appropriately configured socket or channel in a standard mullion. The need for welding the L's in place on the structure is thereby eliminated. An anchor member can also be provided having a keyed base, such as a T-shaped base, which is slidably held in a channel formed in a mullion.

The resilient member can additionally be formed integral with such an anchor-L shape for a one-piece flexible mount. In this one-piece embodiment, the first portion of the resilient member is made of a lower durometer elastomeric material for engaging the edge of the face of the interior light. The second portion of the resilient member is of a significantly higher durometer elastomeric material, and is essentially formed in the shape of and functions in the same manner as the foregoing metal anchor-L. The base leg, or flange, of the L-shaped second portion can, for example, be barbed or ratcheted to press-fit into an appropriately configured socket or channel in a standard mullion.

Some of the advantages realized by the mount and mounting system of the present invention when used as a secondary mount can thus be readily seen. First, and perhaps foremost, the system precludes the catastrophic effects that formally resulted from failure of the primary adherent. If the primary mount fails, the system of the present invention prevents the glass unit from falling out, and enables repair or reattachment of the unit.

The mount is also readily used with standard glass units and building materials. No modification of either the glass unit, building or frame is thus required. Standard field glazing techniques are employed with the present invention, and the ability to unitize is unaffected.

The use of temporary clips to hold the glass unit in place during cure of a primary adherent is also eliminated. The former steps of removing the temporary clips and filling the clip holes are thereby no longer required for field-glazing of a four-sided silicone system.

The connector also allows normal expansion and contraction of the glass lights. All of the advantages of a four-sided silicone system are retained, including less restriction on movement of the lights during expansion and contraction, and a seal with the building against air and water infiltration. Furthermore, point contact along the face of the interior light and undesirable pressure points are substantially eliminated by the present invention.

The foregoing objectives, features and advantages of the invention will be further understood upon consideration of the following detailed description of embodiments of the invention taken in conjunction with the accompanying drawings, in which:

DETAILED DESCRIPTION OF EMBODIMENTS OF THE INVENTION

The invention has presently found particular application as a secondary mounting system for a double-paned glass unit that is secured to a building using a silicone adhesive as a primary mount. While the following embodiments will be described in the context of this application, it will be understood that the invention may have other employments beyond what is specifically described.

Figure 2:
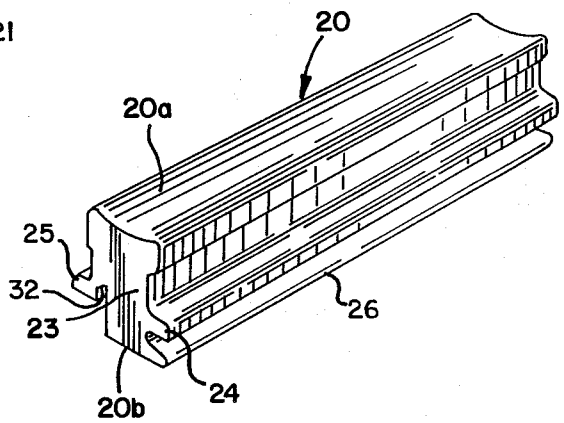
FIG. 2 is perspective view of a first embodiment of a resilient block used in a mount made in accordance with this invention.
Figure 1:
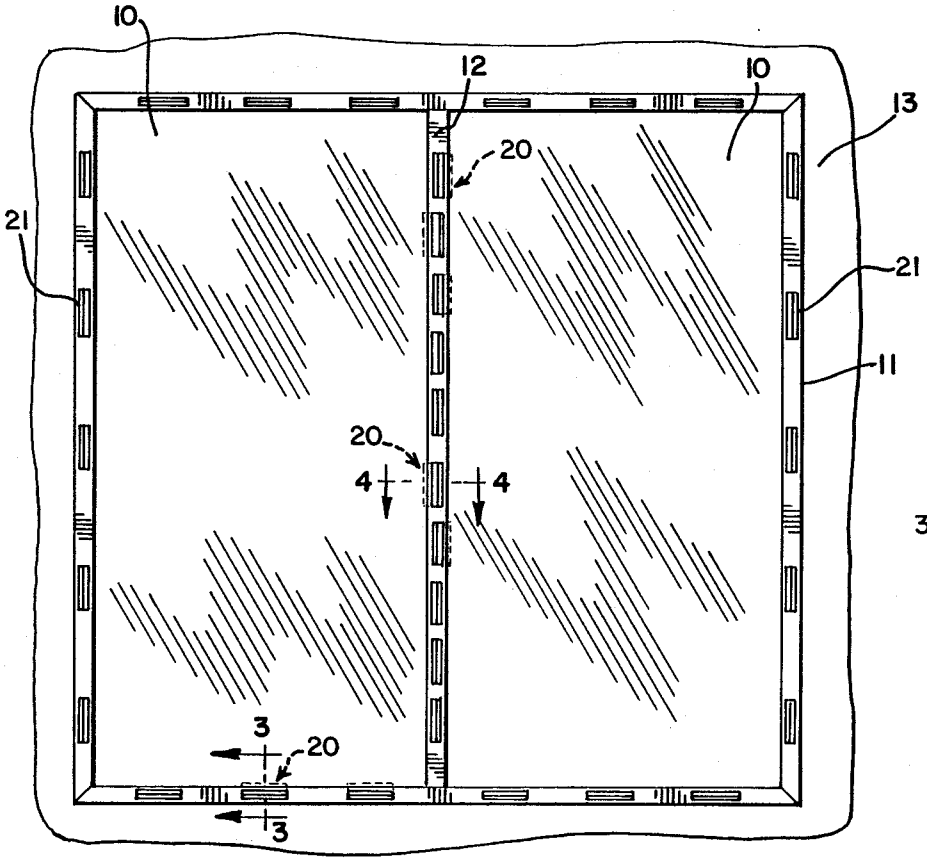
FIG. 1 is a diagrammatic elevational view showing an arrangement of anchor members for mounting of a pair of adjacent glass units.

Referring first to FIG. 1, a pair of glass units 10 are shown as they would be approximately positioned on a frame 11 including a mullion 12 on a building 13. The frame 11 is fixed to the building 13 in a window opening in a conventional fashion well known in the building industry.

Figure 3:
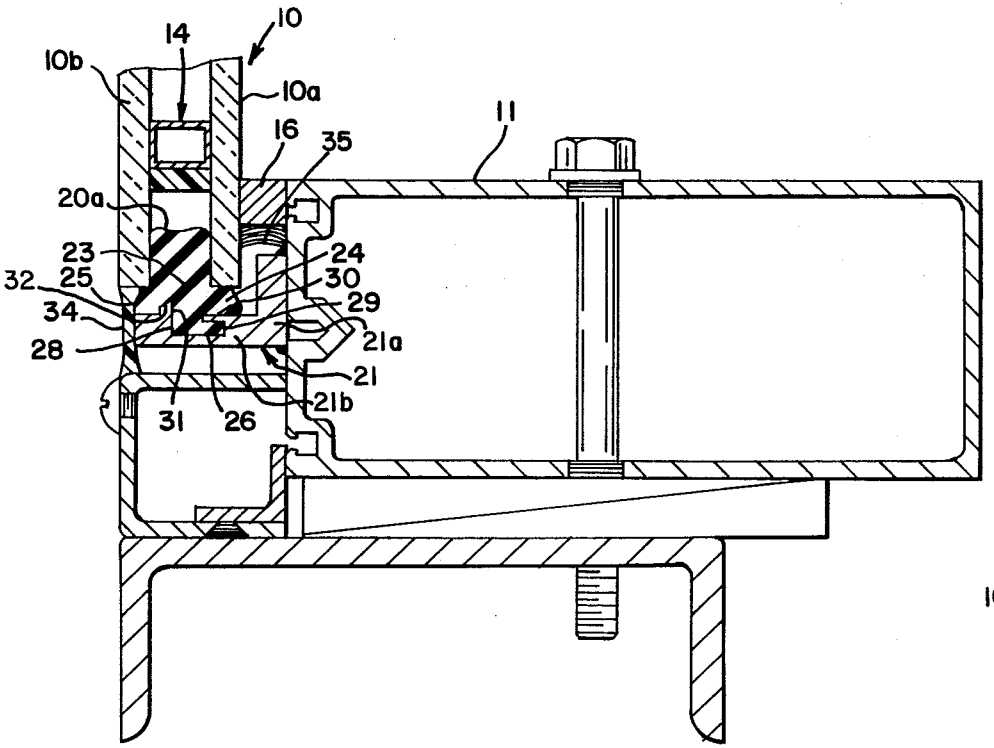
FIG. 3 is a sectional view taken along line 3—3 of FIG. 1.

The glass units 10 are standard double-paned insulative glass units having two panes, or lights, of glass 10*a*, 10*b* (FIGS. 3 and 4); light 10*a* is the interior light. The lights 10*a*, 10*b* are separated by a spacer assembly 14 that is slightly inset from the edge of the unit 10 and extends around the entire perimeter of the unit. The spacer assembly 14 is adhered to both lights in a conventional manner, such as through the use of a one or two part silicone compound. Each unit 10 is thus sealed with an insulative layer of air or other gas sandwiched between the lights.

Each of the units 10 is supported on the frame 11 by a structural seal of a silicone compound. This technique is conventional, and amounts to adhering the unit to the frame 10 with a bead of the silicone compound, such as a bead of silicone 35 around the inboard side of the interior light 10*a*. It will be noted that the gap within which the silicone 35 is located is provided by spacers 16, such as Norton tape, between the interior light 10*a* and the frame 11.

As already noted, the double-paned glass units 10 are standard, and are mounted to a typical frame 11 in a conventional manner using a structural sealant 35. The structural sealant 35 forms the primary means for mounting the units 10. This method of supporting the glass units 10 provides the desired mounting without exterior stops or endcaps. The problem is that each unit 10 is entirely supported by the adhesive bond with the frame 11. If the bond fails, the unit 10 falls out.

A back-up or secondary mount is therefore provided by the present invention in this embodiment. If the sealant fails in the primary (adhesive) mount, the inventive securement holds the unit in place and prevents catastrophic failure of the entire unit mounting.

The mount illustrated in FIGS. 1–7 has two parts. One part is a resilient block 20 (e.g., FIG. 2) made of a rubber or rubber-like material, such as a shore A type EPDM having a durometer of about 70. This elastomer is compatible with the structural silicone sealant used as the primary mount. The block 20 has a first portion 20*a* that fits in the recess or channel formed around the edge of a glass unit 10 between the lights 10*a*, 10*b*, and a second portion 20*b* that extends beyond the perimeter of the unit 10. The other part of the mount is an anchor member in the form of an L-shaped metal bracket 21 (e.g., FIGS. 3 and 4), that has a base or leg 21*a* fixed to the frame 11, and flange 21*b* to which the block second portion 20*b* is attached. As is readily apparent, the block 20 and anchor bracket 21 of the mount are separate from the glass unit, i.e., they are not part of the glass unit.

The block 20 and anchor bracket 21 are engaged or interlocked through a sliding fit. To this end, the second portion 20*b* of the block has a contoured surface that is received and seats within a complimentarily contoured surface of the bracket flange 21*b*.

The second block portion 20*b* when viewed in cross-section (e.g., FIGS. 3 and 4) has a stem 23 from which outboard and inboard lateral flanges 24 and 25 extend. A third lateral flange 26 extends inboard from the end of the stem 23, and is spaced a slight distance away from the other inboard flange 24. These flanges 24–26 extend along the entire longitudinal length of the block 20.

The flange 21*b* of the bracket 21 is configured to interlock with the block second portion 20*b*. It has a recess 28 formed therein with an inboard extending channel or groove 29 defined within the recess. A lip 30 overlies this channel 29. A ridge 31 extends perpendicularly from the flange 21*b*. All of these surface features of flange 21*b* extend along the entire longitudinal length of the flange 21*b*. The recess 28, including the channel 29, are open at each longitudinal end of the flange 21*b*.

The contour of the bracket flange 21*b* exactly matches that of the block second portion 20*b*, so that they interlock when engaged. The flange 26 of the block 20 is first inserted into one end of the channel 29, and then the block 20 is longitudinally slid along the bracket flange 21*b*. Once positioned, the block flanges 24 and 25 are flush with the bracket flange 21*b*, with bracket ridge 31 received in a complimentary recess 32 (FIGS. 2 and 3) formed between stem 23 and flange 25. Block flange 26 is received in channel 29 in a tongue and groove-type connection.

It will be noted that two types of blocks 20 are depicted. The block 20 of FIG. 3 has flanges 24 and 25 which are slightly thicker than those of block 20 illustrated in FIG. 4. This is primarily because the flanges 24, 25 of the FIG. 3 block, which is used along the bottom or base of the unit 10, would bear some of the weight of the glass unit 10 in the event of failure of the primary sealant mount. The blocks along the sides of the unit 10 (FIG. 4) would not be weight bearing. Blocks of the type shown in FIG. 4 are also used along the top of the unit 10.

Figure 5:
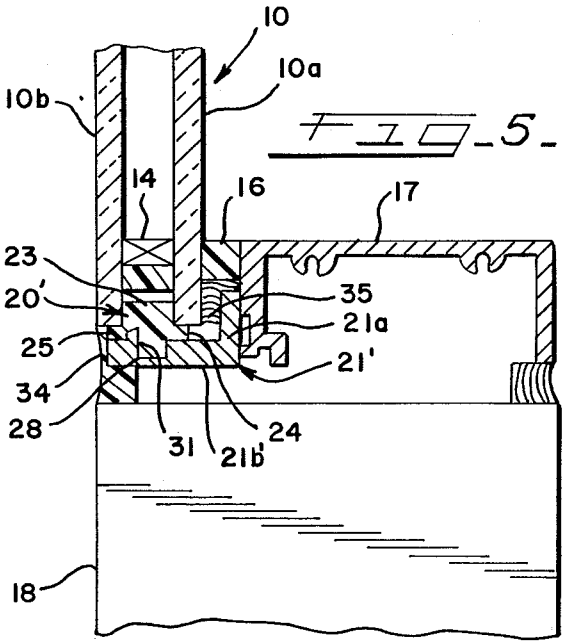
FIG. 5 is a sectional view similar to that of FIG. 3 showing mounting relative to a bulkhead.

Another embodiment of the invention particularly adapted for mounting on top of a bulkhead, for example, is shown in FIG. 5. As in FIG. 3, the block 20' has flanges 24, 25 which extend outwardly from the stem 23 and which would bear some of the weight of the glass unit 10 in the event of failure of the primary mount. It will be noted that the tongue and groove interconnection between flange 26 and channel 29 is omitted in this embodiment. Weather sealant 34 is also given an enlarged bead beneath the outboard end of L-shaped bracket 21', the latter being welded to an extrusion 17. The bulk-head is illustrated at 18.

It will be noted in regard to this FIG. 5 embodiment, and throughout this description, like numbers signify like parts, primed numbers signify parts only slightly modified from those already enumerated, and hundred-series numbers identify similar parts.

Figure 4:
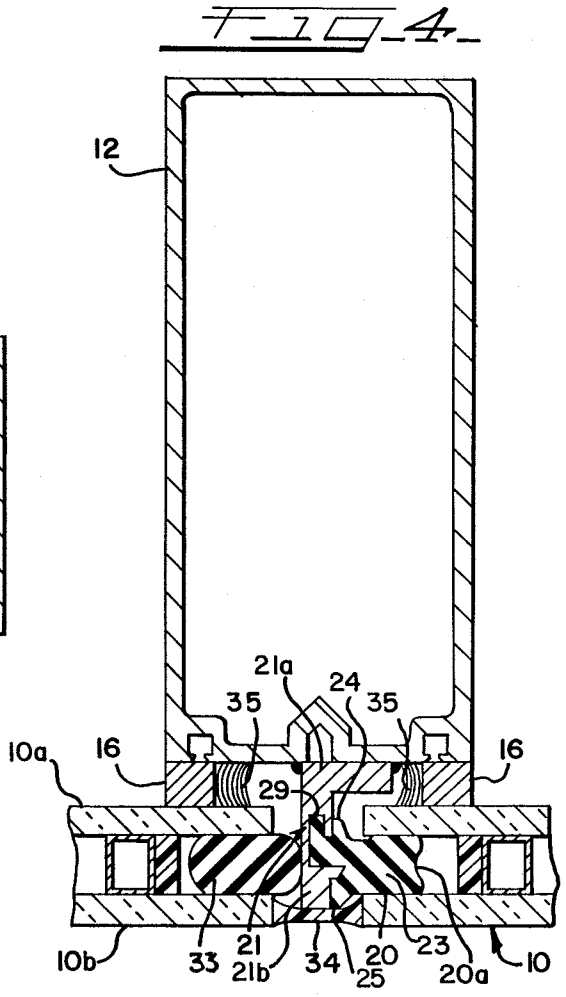
FIG. 4 is a sectional view along line 4—4 of FIG. 1.

FIGS. 1 and 4 illustrate the mounting arrangement used along a vertical mullion 12 which is intermediate two adjacent glass units 10. The anchor brackets 21 are alternated along the length of the mullion 12 so that one set of brackets form part of the mount for one glass unit 10, while every other bracket forms part of the mount for the other glass unit 10. A backer rod 33 made of Denver foam (polyurethane) is used in a conventional fashion to provide a seal along the edge of the unit 10 to prevent the structural silicone from seeping into the channel between the lights 10*a*, 10*b*. The backer rod 33 would be broken up into pieces designed to span the distance between blocks 20.

In the use of this first illustrated embodiment (FIGS. 1–5), a unit 10 is attached to the frame 11 using structural silicone sealant 35 in a conventional manner. Anchor brackets 21 are then fixed to the frame 11, such as by welding. The blocks 20 are thereafter slid into place in the channels along the perimeter of the unit 10 and into engagement with respective anchor brackets 21. A weather seal 34 is provided around the edges of the exterior light 10*b* between the light 10*b* and the frame (FIG. 3) and between adjacent lights 10*b* (FIG. 4). While the invention can be used in field glazing in this manner, it can be employed as well in a unitized arrangement.

An embodiment made in accordance with the foregoing detailed description was tested to determine its supportive capability exclusive of the use of the structural sealant, i.e., as if the structural sealant had completely failed and the unit was supported exclusively by the mounting assembly of this invention. Two standard insulative glass units 10 measuring 4' by 8' in a 7' by 11"

two light wide system were arranged in a manner similar to that depicted in FIG. 1. Anchor brackets 21 were welded to the aluminum extrusion frame 11 so that blocks 20 were located at quarter points along the top and bottom of each unit 10 (the retaining mount illustrated herein along the major axis of each unit being omitted). Mounts were located along the outer sides of the units 10 spaced 6" from the ends (top and bottom) and along the minor axis (3 retaining mounts being used instead of the illustrated 5). The mullion 12 had mounts located 6" from either end in alternating pairs, with a pair of alternating mounts at about the midpoint of the mullion 12 (the other intermediate mounts likewise being omitted). The blocks were 6" in longitudinal length, and manufactured by Tremco of Columbus, Ohio, under the designations TR 214OE and TR 214OE.

The foregoing supportive assembly tested to a pressure of 93 lbs./sq. ft., or an equivalent wind velocity of 193 m.p.h., at which point the mullion 12 rotated and unsealed the unit. That is, the frame 11 failed before the mounting assembly, showing the high reliability of this inventive system.

The use of L-shaped anchor brackets 21 which are welded to a mullion is but one way to fix the mount of this invention to a building. Two additional mounting methods are shown in FIGS. 6 and 7, and particularly relate to securement of the anchor bracket to the building.

Figure 6:
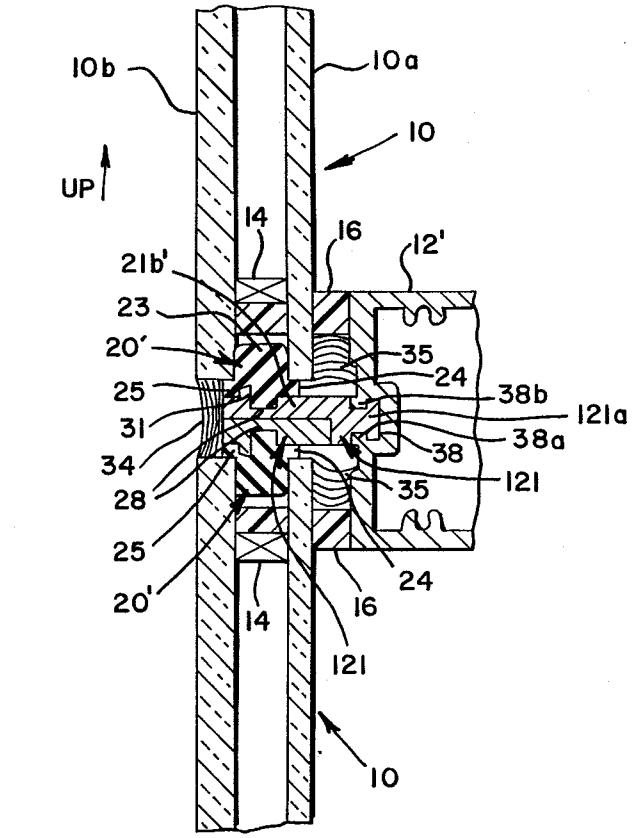
FIG. 6 is a sectional view of the invention with another embodiment of an anchor member, with the view taken vertically through a horizontally extending mullion or extrusion (up being as indicated by the arrow)

With reference to FIG. 6, two standard double-paned glass units 10 are shown (in partial cross-section) secured to a horizontally extending mullion 12'. That is, the mullion 12' extends parallel to the ground. The glass units 10 are thus illustrated as secured one above the other (up being to the viewer's right, as indicated by the arrow). Resilient blocks 20' are substantially identical to those shown in FIG. 5, and are interlocked with the flange portion 21*b*' of a bracket 121. The interlocking engagement between the resilient element 20' and the bracket flange 21*b*' is substantially shown in FIG. 5, and is already adequately described in relation to bracket flange 21*b*' of that figure.

The bracket base 121*a* is modified in this embodiment into a T-shape that engages in a slide fit with a channel 38 formed in the mullion 12'. That is, the head of the T lies in the major part of the channel, with channel overhangs 38*a* and 38*b* being received in grooves defining the stem of the T. Brackets 121 with their T-shaped bases 121*a* are readily assembled to the mullion 12' simply by sliding engagement between the base 121*a* and the channel 38. The bracket 121 can then be slid to the desired location on the mullion 12'. It will be seen in FIG. 6 that two brackets 121 are illustrated, along with corresponding resilient members 20', such that mounts for the upper and lower glass units 10 alternate along the horizontal mullion 12'.

Figure 7:
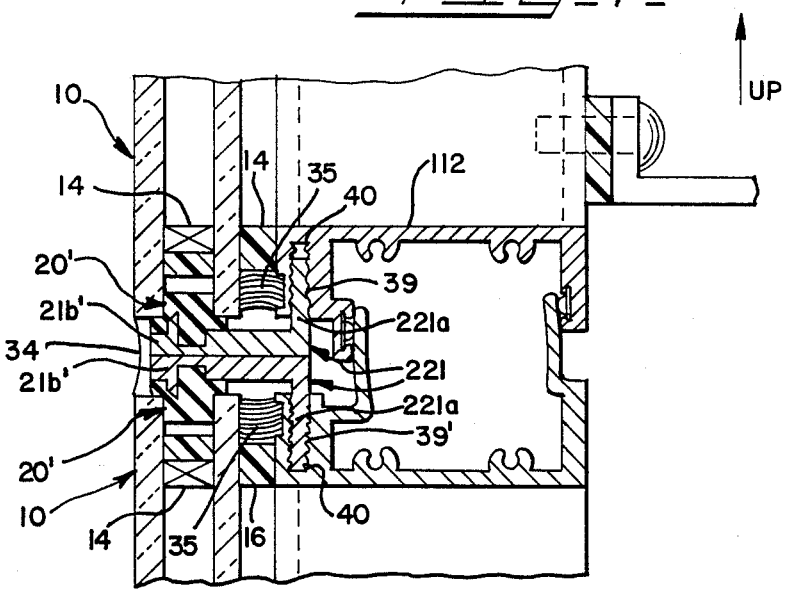
FIG. 7 is a sectional view of the invention with yet another embodiment of an anchor member, with the view taken vertically through a horizontally extending mullion or extrusion, (up being as indicated by the arrow)

FIG. 7 shows another embodiment of the mount of this invention which is substantially identical to that shown in FIG. 6, except for a modification to the base of the anchor bracket for engagement with another type of mullion. In this case, mullion 112 is a split aluminum type mullion. As in FIG. 6, two glass units 10 are shown one above another, with up as indicated by the arrow. Mullion 112 extends horizontally.

The mullion 112 has channels 40 formed therein. These channels may have smooth walls, or can be serrated (ridged). A modified anchor bracket 221 has a flange portion 21*b*' that is substantially identical to the flange portion of the FIG. 5 embodiment. The interlocking engagement of the flange portion 21*b*' with resilient member 20' will therefore not be further described. Bracket base 221*a* is modified, however, to engage with channel 40 in a snap-type or ratchet attachment. The base 221*a* is somewhat elongated, and is advantageously provided with ridges 39 (upper anchor bracket), or more exaggerated serrations 39' (lower anchor bracket). In the embodiment of FIG. 7, the mount is thus located by inserting the base 221*a* into the respective channel 40, and then forceably driving the base 221*a* into the channel 40. Bracket members 221 are alternated across the mullion 112 in mounting upper and lower glass units 10.

Figure 8:
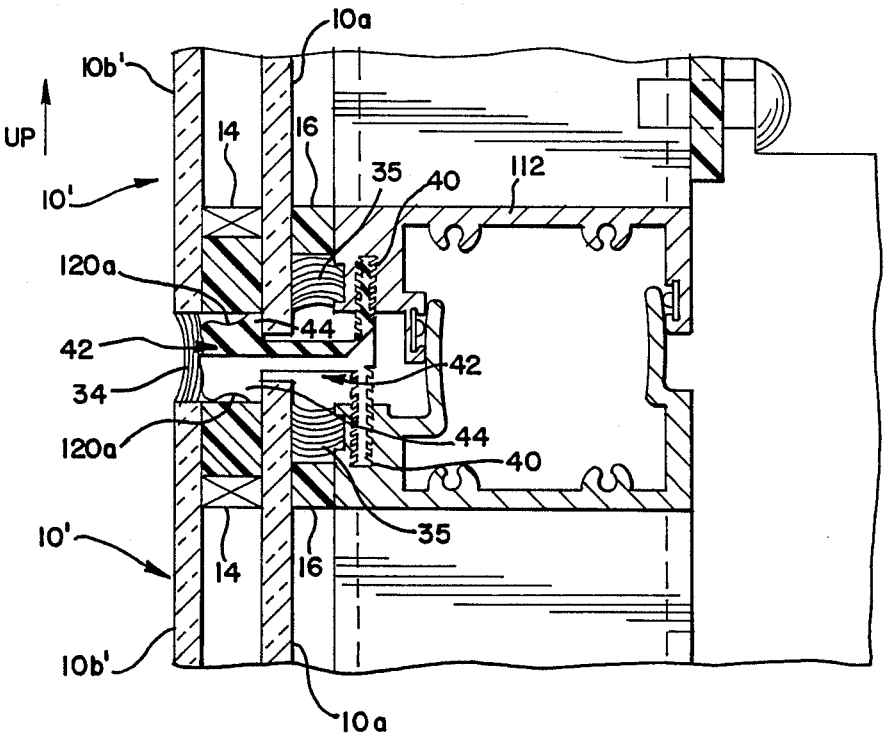
FIG. 8 is a sectional view of another embodiment of the invention, with the view taken vertically through a horizontally extending mullion or extrusion (up being as indicated by the arrow)

FIG. 8 shows an embodiment of the invention particularly adapted for use with double-paned glass units 10' made up of an interior light 10*a* and exterior light 10*b*' which is inset relative to the interior light 10*a*. The glass units 10' are otherwise standard. Mullion 112 is substantially identical to the mullion in FIG. 7.

A mount such as that shown in FIG. 7 can be readily used with the inset light glass unit 10', and such a mount is schematically indicated in FIG. 8 at 42. As is evident from FIG. 8, an edge 44 of resilient first portion 120*a* of the mount 42 engages the edge of the face of the interior light 10*a* which is opposed to the light 10*b*' (i.e., the outward face of light 10*a*).

Figure 9:
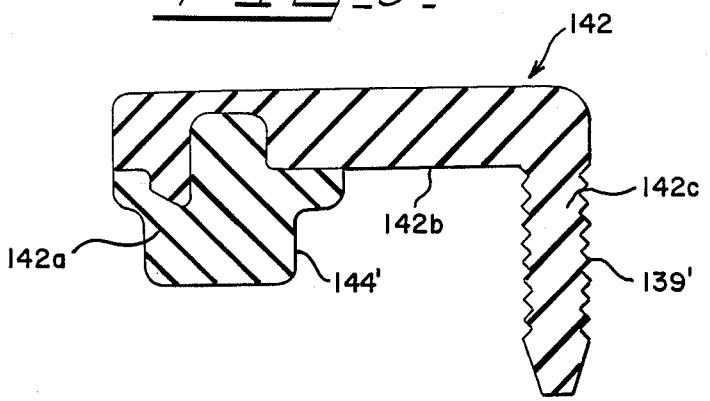
FIG. 9 is another embodiment of the invention wherein the resilient member and anchor member are integrated and made of differing durometer material.
Figure 10:
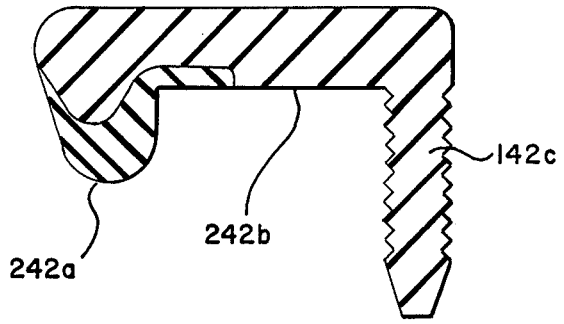
FIG. 10 is yet another embodiment of the invention similar to that of FIG. 9.

The schematically illustrated mount 42 could also be of the type shown in FIGS. 9 and 10, for example. FIG. 9 shows a one-piece elastomeric mount 142. Mount 142 has a first part 142*a* which fits within a channel between the lights of a glass unit 10, or simply grips the interior light of a glass unit 10' having an exterior inset light. Edge 144' of first portion 142*a* would grip a portion of the outboard face of the interior light 10*a*' in this latter application.

First portion 142*a* is essentially a resilient block of the type denominated by 20' in FIGS. 5–7, which is molded integral with a higher durometer, but resilient, anchor portion 142*b*, 142*c* shaped like the bracket 221 of FIG. 7. The contours of the foregoing resilient block 20' and anchor bracket 221 are thus seen as preserved in the mount 142 of FIG. 9.

There is an elongated flange 142*c* roughly perpendicular to the anchor portion 142*b*, which is provided with serrations 139' for engagement with the walls of a mullion channel 40, for example. The durometer of the anchor portion 142*b*, 142*c* can be left to choice, although the durometer should be chosen to render the anchor portion 142*b*, 142*c* at least semi-rigid, and preferably substantially rigid.

FIG. 10 shows a variation on the integral resilient mount of FIG. 9. The FIG. 10 embodiment has a first portion 242*a* of about a 70 durometer rubber or rubber-like material. First portion 242*a* presents a somewhat rounded edge configuration for insertion in a channel between the lights of a double-paned glass, or for simply catching the outward face of an interior light of a glass unit 10' having an inset exterior light. Molded integral with first portion 242*a* is an anchor portion 242*b*, 142*c* which is substantially similar to the anchor portion of the FIG. 9 embodiment, except for the contour of the interface between the anchor portion 242*b*, and the first portion 242*a*. Anchor portion 242*b*, 142*c* is of a higher durometer than that of the first portion 242*a*.

Thus, while the invention has been described in connection with some present embodiments, those skilled in this art will recognize modifications of structure, elements, arrangement, portions, materials and the like that can be used in the practice of the invention without departing from the principles of this invention.

We claim:

1. A mount in a double-paned glass unit having two plates of glass comprised of an exterior plate and an interior plate joined together in spaced apart relation by means spaced inwardly from the perimeter of the glass unit thereby presenting a pair of opposed plate faces and a pair of outboard faces, with an outboard opening channel formed between the opposed faces of the glass plates along the perimeter of the glass unit, the exterior plate forming the outside facing part of the glass unit when the glass unit is mounted in a window opening formed in a structure, the mount comprising:

an elongated one-piece resilient elastomeric member having a first portion received in the channel formed between the glass plates, and a second portion extending beyond the perimeter of the glass unit, and means for mechanically fixing said second portion of said resilient member within the window opening, said resilient member being separate from said glass unit and operative to retain the glass unit in place within the window opening through engagement of the opposed interior plate face without requiring any substantial engagement of the outboard face of the exterior plate.

2. The mount for a double-paned glass unit of claim 1 comprising a plurality of one-piece resilient members and a like plurality of means for fixing said resilient member second portion within the window opening, said resilient members being located in spaced relation about the perimeter of the glass unit, and wherein the fixing means comprises means for interlocking engagement between said resilient member second portion and an anchor member fixed to the structure.

3. The mount for a double-paned glass unit of claim 2 wherein said interlocking engagement means comprises a contoured surface formed on one of said resilient member second portion and said anchor member presenting at least one tongue, said contoured surface being slidably received in a complimentarily contoured area of the other of said anchor member and resilient member second portion, which complimentarily contoured surface presents at least one groove within which said tongue is slidably received.

4. The mount for a double-paned glass unit of claim 2 wherein said interlocking means comprises a stem formed on said resilient member second portion extending outboard from the glass unit and a tongue extending perpendicularly from said stem, said tongue being slidably seated in a groove formed in said anchor member to fix said resilient member second portion to said anchor member.

5. The mount for a double-paned glass unit of claim 4 wherein said anchor member is a bracket having a base which is secured to the structure adjacent the window opening, and a portion extending from said base and outwardly from the window opening, said bracket portion having a contoured surface formed therein including a recessed area with a groove within which contoured bracket surface said resilient member second portion is slidably received and seats.

6. A system in securely mounting to a building a double-paned glass unit having two plates of glass comprised of an exterior plate and an interior plate joined together in spaced apart relation by means spaced inwardly from the perimeter of the glass unit thereby presenting a pair of opposed plate faces with an outboard opening channel formed by the opposed faces of the glass plates along the perimeter of the glass unit, the exterior plate having an outboard face facing outwardly when mounted to the building in a window opening, the system comprising:

a plurality of elongated resilient one-piece elastomeric block members having a first portion received in the channel formed between the glass plates, and a second portion extending beyond the perimeter of the glass unit, said resilient members being located in spaced relation about the perimeter of the glass unit, and means for mechanically fixing each of said second portions to the building, said resilient members being separate from said glass unit and operative to retain the glass unit in place in the window opening through engagement of the opposed face of the interior plate without any substantial engagement of the outboard face of the exterior plate.

7. The system of claim 6 wherein said resilient member second portion is shaped to interlock with an anchor member on the building comprising said fixing means.

8. The system of claim 7 wherein said anchor member is a bracket having a base that is fixed to the building and a portion extending from said base having a recess formed therein defining a channel, said block second portion having a flange formed thereon that is slidably received in said bracket base channel to interlock said block second portion with said bracket.

9. A mount in attaching to a building a double-paned glass unit having two plates of glass comprised of an exterior and an interior light joined together in spaced relation with the lights thereby presenting a pair of opposed faces, the lights being joined solely along the opposed faces, with an outboard opening channel formed between the opposed faces of the lights along the perimeter of the glass unit, the exterior plate having an outboard face facing outwardly when mounted to the building in a window opening, the mount comprising:

a primary adhesive securement for the glass unit including an adhesive bond between the unit and the building, and a separate secondary securement for the glass unit comprised of retaining mounts each having an elongated resilient one-piece elastomeric member with a first portion received in the channel formed between the lights and a second portion extending beyond the perimeter of the glass unit, and means for mechanically fixing said second portion to the building, said resilient members being operative to retain the glass unit in place in the window opening through engagement of the opposed face of the interior light without requiring any substantial engagement of the outboard face of the exterior light.

10. The mount for a double-paned glass unit of claim 9 wherein said means for fixing said resilient member second portion to the building comprises means for interlocking engagement between said second portion and an anchor member fixed to the building.

11. The mount for a double-paned glass unit of claim 10 wherein said interlocking engagement means comprises a contoured area formed on one of said resilient member second portion and said anchor member presenting at least one tongue, said contoured area is slidably received in a complimentarily contoured area of the other of said anchor member and resilient member second portion which complimentarily contoured area presents at least one groove within which said tongue is slidably received.

12. The mount for a double-paned glass unit of claim 11 wherein said interlocking means comprises a stem on said resilient member second portion extending outboard from said glass unit and a tongue extending perpendicularly from said stem, said tongue being slidably seated in a groove formed in said anchor member to fix said resilient member to said anchor member.

13. The mount for a double-paned glass unit of claim 12 wherein said anchor member is a bracket having a base which is secured to the building, and a portion extending from said base, said bracket portion having a contoured surface formed therein including a recess with a groove, within which bracket contoured surface said resilient member second portion is slidably received and seats.

14. A system in securely mounting to a building a double-paned glass unit having two plates of glass comprised of an exterior and an interior plate joined together in spaced relation with the plates thereby presenting a pair of opposed adjacent faces, the plates being joined along the opposed faces with an outboard opening channel formed between the opposed faces of the glass plates along the perimeter of the glass unit, the exterior plate having an outboard face facing outwardly when mounted to the building in a window opening, the mount comprising:

a primary adhesive securement for the glass unit including an adhesive bond between the unit and the building, and a separate secondary securement for the glass unit comprised of a plurality of retaining mounts each comprised of an elongated resilient one-piece elastomeric block member having a first portion received in the channel formed between the glass plates, and a second portion extending beyond the perimeter of the glass unit, said resilient members being located in spaced relation about the perimeter of the glass unit, and means for mechanically fixing each of said second portions to the building, said resilient members being operative to retain the glass unit in place in the window opening through engagement of the opposed face of the interior plate without requiring any substantial engagement of the outboard face of the exterior plate.

15. The system of claim 14 wherein said second portion is shaped to interlock with an anchor member on the building.

16. The system of claim 15 wherein said anchor member is a bracket having a base that is fixed to the building and a portion extending from said base having a recess formed therein defining a channel, said block second portion having a flange formed thereon that is slidably received in said base channel to interlock said block second portion with said bracket.

17. A method in securely mounting to a building a double-paned glass unit having two plates of glass comprised of an exterior and an interior plate joined together in spaced apart relation with the plates thereby presenting a pair of opposed faces, the plates being joined by means spaced inwardly from the perimeter of the glass unit, with an outboard opening channel formed between the opposed faces of the glass plates along the perimeter of the glass unit, the exterior plate having an outboard face facing outwardly when mounted to the building in a window opening, the method comprising the steps of:

attaching the glass unit to the building using an adhesive bond between the unit and the building as a primary securement, and further attaching the glass unit to the building using a separate secondary securement comprised of a plurality of retaining mounts each including an elongated resilient elastomeric one-piece block member having a first portion received in the channel formed between the glass plates and a second portion, said resilient members being located in spaced relation about the perimeter of the glass unit, and means for mechanically fixing each of said second portions to the building, said second portion extending beyond the perimeter of the unit and being shaped to interlock with respective brackets fixed to the building and forming said fixing means, said brackets each having a base that is fixed to the building and a portion extending from said base having a recess formed therein defining a groove, each said block second portion having a flange formed thereon that is slidably received in said groove to interlock said block second portion with a respective bracket, said secondary securement being applied by:

first securing said brackets to the building about the perimeter of the glass unit, and then sliding said block second portions into respective bracket grooves with said block first portions thereby being located within the glass unit channel, said resilient members being operative to retain the glass unit in place in the window opening through engagement of the opposed face of the interior plate without requiring any substantial engagement of the outboard face of the exterior plate.

* * * * *